US006174391B1

(12) United States Patent
Chen et al.

(10) Patent No.: US 6,174,391 B1
(45) Date of Patent: Jan. 16, 2001

(54) MAGNESIUM-FUELED PYROTECHNIC COMPOSITIONS AND PROCESSES BASED ON ELVAX-CYCLOHEXANE COATING TECHNOLOGY

(75) Inventors: Gary Chen, Succasunna; Russell Broad, Passaic; Rene W. Valentine, Landing; Gregory S. Mannix, Ogdensburg, all of NJ (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/388,083

(22) Filed: Aug. 30, 1999

Related U.S. Application Data

(60) Provisional application No. 60/122,951, filed on Mar. 5, 1999.

(51) Int. Cl.[7] ..... C06B 45/10; C06B 45/32; D03D 23/00

(52) U.S. Cl. ..... 149/19.92; 149/6; 149/19.3; 149/109.6

(58) Field of Search ..... 149/6, 19.3, 19.91, 149/19.92, 87; 102/336, 363

(56) References Cited

U.S. PATENT DOCUMENTS 3,898,076 * 8/1975 Ranke ..... 75/3
4,548,660 * 10/1985 Ikeda et al. ..... 149/21
5,834,680 * 11/1998 Nielson et al. ..... 102/336

OTHER PUBLICATIONS

Taylor et al, "Organic Coatings to Improve the Storageability and Safety of Pyrotechnic Compositions", p. 2–4, Nov. 1987.*

L.V. de Yong, "Corrosion Protection of Magnesium Powder in Pyrotechnic Compositions", p. 196–199, Jul. 1992.*

* cited by examiner

*Primary Examiner*—Charles T. Jordan
*Assistant Examiner*—Aileen J. Baker
(74) *Attorney, Agent, or Firm*—Robert Charles Beam; Michael C. Sachs; John F. Moran

(57) ABSTRACT

Storage-stable metal-fueled pyrotechnics and methods for manufacturing such compositions are provided. These are manufactured by granulating a mixture of liquid cyclohexane, powdered metal fuel, optional Teflon® powder, and at least one ethylene and vinyl acetate co-polymer, together to form a storage stable powdered metal fuel effectively coated with ethylene and vinyl acetate co-polymer. This provides pyrotechnics with superior resistance to degradation induced by atmospheric moisture, and having other improved properties. The powdered metal fuel includes, for example, powdered magnesium.

21 Claims, 2 Drawing Sheets

MAGNESIUM-FUELED PYROTECHNIC COMPOSITIONS AND PROCESSES BASED ON ELVAX-CYCLOHEXANE COATING TECHNOLOGY

RELATED APPLICATIONS

This application claims benefit of filing date Mar. 5, 1999 of provisional application 60/122,951, the entire file wrapper contents of which application are herewith incorporated by reference as though fully set forth herein at length.

U.S. GOVERNMENT INTEREST

The invention described herein may be manufactured, used and licensed by or for the U.S. Government for U.S. Government Purposes.

FIELD OF THE INVENTION

The invention relates to storage-stabilized magnesium and aluminum-fueled pyrotechnic compositions and a process for their manufacture.

BACKGROUND OF THE INVENTION

Many of the currently fuelded pyrotechnic munitions contain magnesium as a primary fuel, which is used with a host of other ingredients to produce light, sound, luminosity, or infrared emissions. Magnesium has many unique advantages as a pyrotechnic fuel, relative to other metal fuels. These include, for example, high reactivity, high heat of combustion and a low boiling point. Magnesium is available in both the atomized (spherical) and ground (oblong, ellipsoidal, or flake) forms.

However, despite these many unique advantages provided by magnesium as a pyrotechnic fuel, magnesium-fueled pyrotechnics, and to a lesser extent, aluminum fueled pyrotechnics, are also known to suffer from a very dangerous shortcoming. Specifically, they are very vulnerable to degradation by moisture during their life-cycle, resulting in the release, or out-gassing, of highly flammable hydrogen gas.

The solubility of magnesium oxide in acidic media, and the solubility of aluminum oxide in both acidic and basic media, are believed to contribute to this tendency to degrade in the presence of moisture. The degradation rate is more pronounced for magnesium because, relative to aluminum, the magnesium oxide coating is porous and comparatively non-protective. The high reactivity of magnesium, and the high particle surface area employed in these formulations also contributes to these undesirable degradation reactions for magnesium, especially with particle sizes in that are typically on the order of about 45–75 microns or less. Flammable hydrogen, together with magnesium hydroxide, is generated, for instance, through the following reaction:

$$Mg+2H_2O \Longrightarrow Mg(OH)_2+H_2$$

The above reaction is accelerated when the pyrotechnic compositions are stored under conditions of high temperature and humidity, and is more vigorous when a relatively small particle size of magnesium is used. Generation of hydrogen (out-gassing) not only creates a highly explosive atmosphere, but also ruptures seals and cases in ordnance, resulting in severe safety, logistical, environmental, cost, and political consequences. In a further hazard, degraded ordnance often produces undesirable burning characteristics, resulting in poor performance. In addition, when metal fuel containing pyrotechnic munitions are severely degraded during prolonged storage in a hostile environment, the costs for demilitarization and disposal can be very significant.

As mentioned above, the art has been aware of these problems, and there have been previous attempts at preventing this hazard or containing the resulting hydrogen gas.

(1) Moisture control. Controlling the humidity level in the load plants and drying pyrotechnic ingredients, assembly components and packaging materials are two common methods employed in an effort to minimize pyrotechnic degradation by moisture. However, this is an expensive proposition, and given the need for the presence of some humidity (typically 40–50% relative humidity) to prevent electrostatic discharge ("ESD") or buildup, total dryness cannot always be achieved.

(2) Alternative materials. Alternative fuels, such as powdered aluminum, have been successful for a limited number of pyrotechnic items such as the M115 and M116 simulators. For most purposes, however, aluminum cannot compare to magnesium in performance, e.g., burn times, rise times, spectral outputs, candlepowers, color values, etc. These shortcomings derive from the fact that aluminum has a significantly higher boiling point and lower reactivity, relative to magnesium. The other disadvantage of aluminum as a metal fuel, relative to magnesium, is as mentioned above, in contrast to magnesium, aluminum-containing alkaline metal nitrate oxidizer compositions are unstable in the presence of moisture. In addition, pyrotechnics prepared from aluminum particles of 16 microns or less, can also undergo an analogous degradation reaction, although at a slower rate, thus necessitating protective measures for aluminum, as well.

(3) Packaging with barrier bags. Most pyrotechnic items are packed in barrier bags during manufacturing to prolong their shelf-life, but when moisture-induced out-gassing does occur, possibly due to pinhole-sized breaks in the barrier material, or due to pre-packaging exposure to moisture, the packaging can swell up with hydrogen gas, creating an additional safety hazard, so that shipping such materials requires special precautions and waivers from the U.S. Department of Transportation.

(4) Release of hydrogen gas. Personnel in the fuelds or at depots cut holes through the bulging barrier bags with knives to release hydrogen to the atmosphere and then repack the ordinance. Unfortunately, this has lead to at least one reported instance of fire and injury to personnel.

There have also been efforts to render particulate metal fuels, such as magnesium, hydrophobic by coating the particles with organic resins. For example, several authors have described the use of ethylene and vinyl acetate co-polymers to render metal fuel particles hydrophobic and resistant to moisture induced degradation. These resin copolymers have a desirably high tensile strength and produce a protective hard surface that minimizes abrasion. Ethylene and vinyl acetate co-polymers are commercially available under the tradename of Elvax® (E.I. Dupont De Nemours & Company, Wilmington, Del.). Elvax® is available in a number of grades and weights, including the 40W, 150W, 240W, 265W and 360W formulations, among others.

Taylor et al., 1987 ("Organic Coatings to Improve the Storageability and Safety of Pyrotechnic Compositions," Technical Report ARAED-TR-87022, US Army Research, Development and Engineering Center, Picatinny Arsenal, N.J., USA), prepared Elvax® 360 coated magnesium powder by a method that included stirring magnesium powder into a 5% solution of Elvax® 360 dissolved in toluene. L. V. Yong, 1992, ("Corrosion Production of Magnesium Powder in Pyrotechnic Compositions," Australia, Eighteenth International Pyrotechnic Seminar, 13–17 July) reported magnesium particles coated with Elvax® dissolved in toluene, using a slurry coating technique.

The processes proposed by both Taylor et al. and by Yong, employ toluene, which is extremely toxic and is on the EPA priority HazMats list of extremely toxic or carcinogenic chemicals. In addition, toluene has a higher boiling point (110° C.), relative to other solvents used in pyrotechnic productions, e.g., alcohol. However, Yong failed to provide methods for manufacturing tetrafluoroethylene (Teflon®)—containing pyrotechnic compositions. Taylor et al. appears to have described only dry blending techniques to prepare Elvax®—containing magnesium-Teflon flare compositions. It should be noted that Yong did not test 240W Elvax® and Taylor et al. did not test 40W, 15W, and 240W grades of Elvax®. Regardless of the techniques or processes used by Yong and Taylor et al., products produced by those methods have not solved the longstanding out-gassing problem as recognized by the art.

Thus, there remains a need in the art for improved methods and compositions for producing metal-particle pyrotechnic compositions which have the following desirable properties. Further, there remains a need in the art for a scalable granulation process for producing magnesium and/or aluminum pyrotechnics that are successfully protected by Elvax®.

SUMMARY OF THE INVENTION

In order to solve these and other problems, the invention provides methods for protecting magnesium and/or aluminum-fueled pyrotechnics from adsorption of environmental water so as to provide for a storage stable form of such metal-fueled pyrotechnics. In particular, the compositions and methods of the invention provide for a successfuil mulling/granulation process for producing Elvax®—protected pyrotechnic compositions having the following desirable features. Storage stable pyrotechnic compositions manufactured by these methods, as well as pyrotechnic devices, e.g., flares, explosives, propellants and incendiary devices, manufactured by art-standard methods to contain the improved pyrotechnic compositions of the invention, are also provided.

1. The components of the coated metal fuel powders are more uniformly and intimately mixed by the inventive processes, resulting in powdered metal fuels that are more uniformly coated, with improved resistance to environmental moisture relative to pyrotechnics produced by previous methods.
2. The coated metal fuel powders produced by the inventive processes are reproducible in their desirable properties. For example: resistance to moisture-induced degradation and hydrogen outgassing, ballistic performance, and mechanical strength. The coated metal fuel powders are also ready for loading and assembly to mass produce pyrotechnic devices, and will not segregate to jeopardize performance of the pyrotechnic product.
3. The inventive processes are environmentally safer, more efficient and less costly, e.g., by avoiding the use of toluene and substituting safer and lower boiling point solvent(s).
4. The coated metal fuel powders are more free-flowing, compared to previously prepared products, and less dusty, for improved handling and reduced fire-hazard during manufacturing.

The storage-stable powdered metal fuels and/or pyrotechnic compositions of the invention are manufactured by a process that includes the steps of granulating a mixture of liquid cyclohexane, powdered metal fuel, and at least one ethylene and vinyl acetate co-polymer, and allowing the formed granulation to dry.

The granulating step is conducted, for example, by mixing a pre-prepared solution of at least one vinyl acetate co-polymer dissolved in cyclohexane with the powdered metal fuel until a smooth mixture is formed, and then mulling the smooth mixture while allowing the cyclohexane to evaporate, until a cyclohexane-moist granulate or lumps are formed. The formed granulate is then optionally sieved to a desired particle size before drying. The employed pre-prepared solution preferably includes vinyl acetate co-polymer in a concentration ranging, by weight, from about 3 percent to about 10 percent.

Once dried, the resulting product preferably includes vinyl acetate co-polymer in a proportion ranging from about 3 percent to about 10 percent, by dry weight, and more preferably in a proportion ranging from about 5 percent to about 10 percent, by dry weight.

The powdered metal fuel preferably includes a metal selected from the group consisting of powdered magnesium, powdered aluminum and/or combinations thereof, although other metals, metal oxides and/or metal salts can optionally be included, as will be appreciated by the artisan. The magnesium powder preferably has a size ranging from about 30 to about 325 mesh. The magnesium powder can be prepared by being atomized or ground, and is optionally prepared on site or purchased in a pre-prepared form.

Further, the ethylene and vinyl acetate co-polymer is preferably a grade of Elvax® suitable for the particular application and desired pyrotechnic device, for example, a grade that includes Elvax® 40W, 150W, 240W, 265W, and/or combinations thereof. Optionally, numerous other grades of ethylene and vinyl acetate co-polymer that are commercially available from Dupont and/or may be prepared by the artisan, can be employed for specific end-uses.

In order to produce storage-stable powdered metal fuels and compositions suitable for, e.g., producing flare devices, powdered tetrafluoroethylene is optionally mixed together with the powdered metal and the pre-prepared solution of ethylene and vinyl acetate co-polymer during the manufacturing process. Preferably, the proportion of powdered tetrafluoroethylene in this mixture ranges from about 15 to about 25 percent by weight, although this range can optionally be varied depending upon the desired final product.

Methods for manufacturing the above-described storage-stable metal fuels and/or pyrotechnics are also provided herein.

A—Uncoated Magnesium Powder (Reference);
B—3% 40W Elvax®—Coated Magnesium Powder;
C—3% 150W Elvax®—Coated Magnesium Powder;
D—7% 40W Elvax®—Coated Magnesium Powder;
E—10% 40W Elvax®—Coated Magnesium Powder;

F—7% 150W Elvax®—Coated Magnesium Powder;

G—10% 150W Elvax®—Coated Magnesium Powder; and

H—7% 240W Elvax®—Coated Magnesium Powder.

Figure 2:
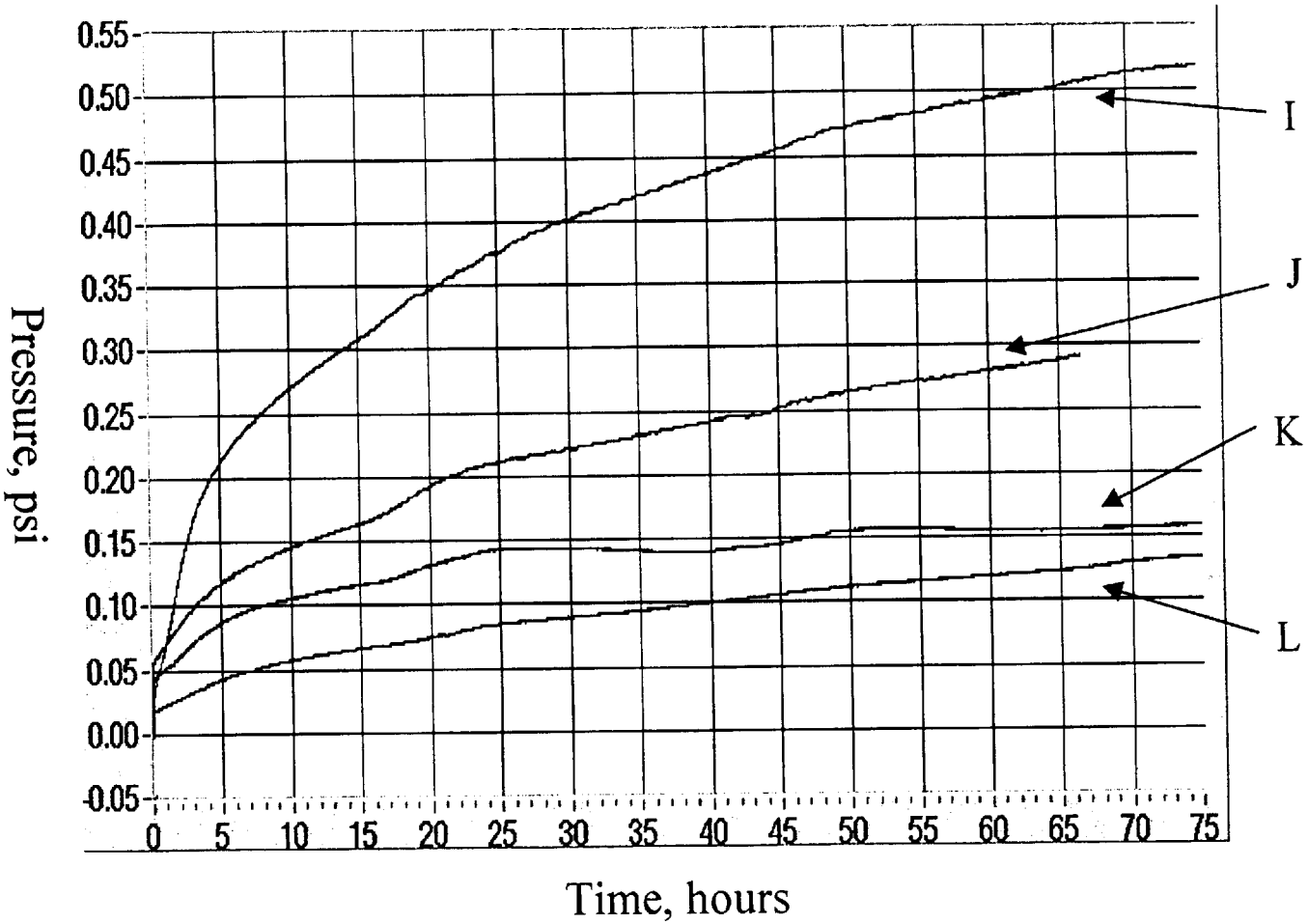

FIG. 2 graphically illustrates the hydrogen pressure generated in a fixed volume chamber, versus time, for wetted Elvax®—coated Teflon® magnesium powder, and uncoated control, at ambient temperature. The pressure-time curves are alphabetically labeled as follows.

I—5% Hycar-Coated Magnesium-Teflon® Powder (Reference);

J—5% 40W Elvax-Coated Magnesium-Teflon® Powder;

K—5% 150W Elvax-Coated Magnesium-Teflon® Powder; and

L—5% 240W Elvax-Coated Magnesium-Teflon® Powder.

DETAILED DESCRIPTION OF THE PREFERRED EMBODIMENTS

Accordingly, the invention provides novel and improved processes for coating fine particles of metal fuels, including magnesium and aluminum, and optionally, combinations thereof, with a hydrophobic co-polymer of ethylene and vinyl acetate, to produce novel and improved storage stable pyrotechnic compositions. Preferably, the hydrophobic polymer includes one or more grades of ethylene and vinyl acetate co-polymers, commercially available as various grades of Elvax®, as described supra. In addition, it has been unexpectedly discovered that there is no requirement to use a toxic aromatic solvent, such as toluene, as a carrier for the ethylene and vinyl acetate co-polymers. Instead, suitable hydrocarbon solvents with a boiling point lower than that of toluene, e.g., less than 110° C., and more preferably with a boiling point of 81° C., or less, can be employed for this purpose. In fact, the preferred cyclohexane solvent provides a significant improvement over the toluene solvent-based processes employed by both Taylor and Yong, as discussed above. Cyclohexane is environmentally benign, relative to the previously employed toluene, and surprisingly allows for a more efficient coating process, possibly due to its lower boiling point (81° C.), relative to toluene (110° C.).

The invention also provides for a novel coating/manufacturing process that combines the coating of metal fuel particles and the manufacture of pyrotechnic compositions into a unified operation. The process of the invention has successfully been used to produce Elvax® coated magnesium-Teflon® compositions, that have been confirmed to be resistant to moisture-induced degradation.

Reagents

The following reagents are employed in the exemplified processes.

Ethylene and vinyl acetate co-polymer resin: Elvax® (E.I. Dupont De Nemours & Co, Wilmington, Del.) 40W, 150W, 240W, and 265W, among other grades, and optionally combinations of more than one grade.

Polyacrylate elastomer: Hytemp® (Zeon Chemicals Inc., Louisville, Ky.).

Cyclohexane liquid: ACS or equivalent

Tetrafluoroethylene: Teflon® A (E.I. Dupont De Nemours & Co, Wilmington, Del.).

Magnesium powder: The magnesium powder is preferably finely divided to a degree suitable for its desired function, e.g., in a size ranging from about 30 to about 325 mesh. The use of the term, "powdered" herein refers to material that has been sufficiently finely divided for the intended purposes. Preferably, atomized, Military Specification: Mil-P-14067, type 1, 200/325 mesh magnesium is employed. The magnesium powder may be prepared by grinding, and/or it may be atomized, or a mixture thereof.

Optionally, aluminum powder of a fineness suitable for its desired function may be employed alone, or in combination with magnesium.

In a further option, it will be appreciated by the artisan that any other suitable art-known finely divided metal, and/or metal-oxide or metal-salt(s) are usefully added to the metal fuel in order to modulate the burn-rate, burn temperature, spectral output or color of the resulting pyrotechnic device, as will be appreciated by the artisan.

Elvax® Dissolution Properties

The time for dissolving Elvax® in cyclohexane will vary with its concentration, vinyl acetate content, and the dissolving temperature, as shown in Table 1, below. The data for Table 1 was obtained by adding known weights of Elvax® and cyclohexane to a mixing vessel equipped with a stirrer, reflux condenser and a temperature controller. The reflux condenser was always operating to maintain the cyclohexane content, but the operation of the stirrer and temperature controller were varied as indicated to test the tabulated dissolution conditions. Each procedure was run until the Elvax® was completely dissolved in the cyclohexane as indicated by the formation of a clear solution).

TABLE 1

Solubility Characteristics of Elvax ® in Cyclohexane

| Grade of Elvax ® | Concentration in Cyclohex. (wt %) | Temp. (Deg. F.) | Agitation | Dissolving time (hours) | Melt point (Deg. F.) | % Vinyl Acetate | Melt Index |
|---|---|---|---|---|---|---|---|
| 240W | 5 | 120 | No | 5 | 165 | 28 | 43 |
| 240W | 10 | 120 | No | 8 | 165 | 28 | 43 |
| 240W | 10 | 120 | Yes | <8 | 165 | 28 | 43 |
| 150W | 5 | Amb* | Yes | 1 | 145 | 32 | 43 |
| 150W | 10 | Amb* | Yes | 1.5 | 145 | 32 | 43 |
| 150W | 5 | 120 | No | 2 | 145 | 32 | 43 |
| 150W | 10 | 120 | No | 3 | 145 | 32 | 43 |
| 40W | 5 | Amb* | Yes | 0.75 | 117 | 40 | 52 |
| 40W | 10 | Amb* | Yes | 1 | 117 | 40 | 52 |
| 40W | 5 | 120 | No | 1 | 117 | 40 | 52 |
| 40W | 10 | 120 | No | 3 | 117 | 40 | 52 |

*Ambient temperature

Generally, the coating solutions for the 100 series Elvax® resins are prepared at ambient temperature and for 200 series Elvax® resins the preferred temperature is 120° F.

In addition, as illustrated by Table 1, the lower the Elvax® concentration in the cyclohexane, or the higher the concentration vinyl acetate in the Elvax®, the shorter the time to dissolve the Elvax® component. Further, agitation or mixing also shortens the time for Elvax® dissolution. As confirmed by the Examples provided below, the preferred Elvax® coating concentration is 10% (wt/wt) because this concentration optimally minimizes the evaporation time of the cyclohexane.

Coating Process A Moisture Resistant Magnesium Particles

While any suitable equipment may be used for mixing metal particles with Elvax®—cyclohexane coating solution, the inventive process was demonstrated in an open dish mixer at atmospheric pressure, using Elvax®—cyclohexane coating solution pre-prepared as described above. Magnesium powders were completely dispersed in the Elvax®—cyclohexane coating solution during intimate mixing. The mixture was then granulated and dried, resulting in uniform and completely coated particles. The granulated and dried magnesium powders can be stored in a container for use in a dry blending or wet mixing process. The process for semi-scale or full-scale production is essentially the same as demonstrated using the dish mixer, except that a Muller mixer or a Hobart mixer can be used. The process includes the following steps:

(a) Weighed amounts of pre-prepared Elvax®—cyclohexane coating solution and powdered magnesium were added to a porcelain mortar and pestle;

(b) The contents were mixed with the pestle, and if any lumps were present, they were crushed to obtain a complete powder dispersion in the Elvax® solution;

(c) Mixing was continued with pestle until the dispersion turned into firm moist lumps due to evaporation of the cyclohexane.

(d) The firm moist lumps were transferred to an electrically grounded mesh sieve with a pan underneath and the material was pressed through the sieve openings with, for example, a rubber stopper;

(e) The sieved material was spread in a thin layer in a conductive pan; and (f) Dried in an oven for minimum of 8 hours at 120° F. until no noticeable solvent smell was present. A free-flowing powdered product was obtained.

The time required to evaporate a sufficient quantity of cyclohexane from the dispersion until firm moist lumps are formed is readily determined during the first time a particular process is run, and then will serve as a guide for later cycles of the same type of process. Immersing the evaporation dish in a warm water bath (preferably at 120° F.), or optionally with constant evacuation, e.g., with a vacuum pump, with and/or without an external source of heat, will significantly reduce the evaporation time. The artisan will also appreciate that the sieve size is varied in accordance with the product specifications and performance requirements. It should also be mentioned that aluminum fuel particles can also be coated by this process.

Coating Process B Moisture Resistant Magnesium-Teflon® Flare Composition

The coating and manufacturing of magnesium-Teflon®—pyrotechnic compositions were conducted in an open dish mixer simultaneously at atmospheric pressure, using the pre-made Elvax®—cyclohexane coating solution. Magnesium powders were completely dispersed in the Elvax® solution during intimate mixing, resulting in uniform and complete coating around the particles after cyclohexane is evaporated from the mixer. The granulated and dried granules were ready for loading, e.g., into pyrotechnic canisters, in loose or pressed form. For semi-scale or full-scale production, a Muller mixer or a Hobart mixer can be used. The process as exemplified comprises the steps:

1. Weighed amounts of pre-prepared Elvax®—cyclohexane coating solution and powdered magnesium were added to a porcelain mortar and pestle;
2. The contents were mixed with the pestle and if any lumps were present, they were crushed to obtain a complete powder dispersion in the Elvax® solution;
3. A weighed quantity of sieved Teflon® was added to the above fluid dispersion. The mixture was mixed with the pestle to obtain a homogeneous mix;
4. Mixing was continued with pestle and cyclohexane was allowed to evaporate until the dispersion turned into firm moist lumps);
5. The mix was transferred to am electrically grounded sieve with a pan underneath and the material pressed through the sieve openings (14 to 16 mesh) with, for example, a rubber stopper;
6. The sieved granules were spread in a thin layer in a grounded conductive pan; and
7. Dried in an oven for minimum of 8 hours at 120° F. until no noticeable solvent smell was present. A free-flowing powdered product was obtained.

The time required to evaporate a sufficient quantity of cyclohexane from the dispersion until firm moist lumps are formed is somewhat empirical but can be determined by the skilled artisan for a particular batch. Using a warm water bath (preferably at 120° F.) for the dish or constant evacuation of the overhead vapors will significantly reduce the evaporation time.

Of course, it will be appreciated that the size of the sieve holes is varied in accordance with the product specifications and performance requirements.

EXAMPLE 1

Preparing Elvax® Cyclohexane Solution 200 g batches of semi-viscous solutions of Elvax® in cyclohexane, with a range of concentrations, were prepared. The desired quantities, by weight, of each type of Elvax®, together with a weighed quantity of cyclohexane, were added to a 400 ml mixing vessel. The vessel is enclosed with a cover which has provisions for the included reflux condenser, a thermocouple probe, a feed inlet, and a glass stirrer. The temperature of the mixture is controlled at 120° F. with a digital temperature controller. For each solution as exemplified, the total components added up to 200 g. The stirrer, reflux condenser and temperature controller were turned on at the start of each batch preparation. The temperature was raised to 120° F. and slow mixing with the motor-driven glass stirrer continued until the Elvax® was completely dissolved in the cyclohexane (indicated by a clear solution). As soon as the Elvax® was dissolved, the mixing was stopped. The result was 200 g of a semi-viscous solution that was transferred to a storage container for use in the following coating processes. Table 2, below, tabulates the different weights of Elvax® and cyclohexane, respectively, used to prepare solutions of Elvax® 40W, 150W and 240W, respectively. Additional solutions, employing further types of Elvax®, were prepared, as illustrated by Table 2, below.

TABLE 2

Weights of Elvax ® and Cyclohexane For Viscous Elvax ®-Cyclohexane Solutions

| Elvax ® Type and Weight (g) | Cyclohexane (g) | 200 g Solution % Elvax ® |
|---|---|---|
| 40 W - 20 | 180 | 10 |
| 40 W - 15 | 185 | 7.5 |
| 40 W - 14 | 186 | 7 |
| 40 W - 10 | 190 | 5 |
| 40 W - 6 | 194 | 3 |
| 150 W - 20 | 180 | 10 |
| 150 W - 15 | 185 | 7.5 |
| 150 W - 14 | 186 | 7 |
| 150 W - 10 | 190 | 5 |
| 150 W - 6 | 194 | 3 |
| 240 W - 10 | 190 | 5 |

Although not shown in Table 2, a solution that included Elvax-265, was also prepared.

EXAMPLE 2

Preparation of Elvax® 40W-Coated Magnesium Particles

Elvax® coated magnesium particles were prepared according to Process A, described above. Specifically, powdered magnesium, atomized, 200/325 mesh, 186 g, and 140 g of 10% 40W viscous Elvax®—cyclohexane solutions were added to an open dish mixer (porcelain mortar, 8" diameter) and mixed for about 10 minutes with a pestle, and any lumps of magnesium powder were crushed with the pestle. Mixing was continued until a complete powder dispersion in the Elvax® solution was reached. Then the mixture was mulled with the pestle to allow the cyclohexane to gradually evaporate, over a period of about 1 hour, until firm, moist lumps formed. It is recommended that the evaporation/granulation step be conducted under an overhead exhaust fan, but for large scale production, the solvent is optionally condensed and recycled.

The granulation was worked through a U.S. Standard Sieve No. 200, 8" diameter. The sieve was mounted above a sieve pan of the same diameter. The lumps were gently pressed through the sieve openings with a rubber stopper. The particles that passed the screen openings were collected in the underneath sieve pan for the second screening with a U.S. Standard Sieve No. 325 of 8" diameter. Each of the sieved powders (+200, −200/+325, and −325) were spread in a flat plastic pan of 12" (width) by 24" (length) and dried in an oven for a minimum of 8 hours at 120° F. The resulting products are identified as No. 6a, No. 6b, and No. 6c, respectively.

Each of the resulting compositions weighed about 200 g. For instance, the magnesium product that was treated with 10% 40W Elvax®, was composed of 93% magnesium −200 mesh, and 7% Elvax®.

EXAMPLE 3

Preparation of Elvax® 240W-Coated Magnesium Granules

A moisture-resistant powdered magnesium coated with 7% Elvax® 240W was prepared using Process A, as described above. In particular, 200/325 atomized magnesium powders (186 grams) and 10% 240W Elvax®—cyclohexane solution (140 grams) were added to a porcelain mortar of 8" diameter. The mixture was mixed with a porcelain pestle. Lumps in the mixture were crushed until a complete powder dispersion in the Elvax® solution was reached. Under an overhead-exhaust fan, cyclohexane evaporated gradually from the mixture until the dispersion turned into firm moist lumps. In a second step, the lumps from step one were transferred to a U.S. Standard Sieve No. 200 of 8" diameter. The sieve was mounted above a sieve pan of the same diameter. The lumps were gently pressed through the sieve openings with a rubber stopper. The particles that pass the screen openings were collected in the underneath sieve pan for the second screening with a U.S. Standard Sieve No. 325 of 8" diameter. In a third step, each of the sieved powders (+200, −200/+325, and −325) was spread in a flat plastic pan of 12" (width) by 24" (length) and dried in an oven for a minimum of 8 hours at 120° F. The products are identified as No. 1a, No. 1b, and No. 1c respectively.

EXAMPLE 4

Preparation of Elvax® 240W-Coated Maenesium-Teflon® Granules

A moisture-resistant Magnesium-Teflon®-5% Elvax® 240W granular composition was prepared using Process B, as described above. In particular, 200/325 atomized magnesium powders (124 grams) and Elvax® 240W-cyclohexane solution (110 grams) were added to a porcelain mortar of 3.5" (diameter) by 2" (depth) and mixed for approximately 10 minutes with a porcelain pestle. Any lumps in the mixture were crushed until a complete powder dispersion in the Elvax® solution was reached. Next, the sieved Teflon® powder (66 grams) was added to the mortar under mixing. Under an overhead-exhausted fan, cyclohexane evaporated gradually from the mixture until the dispersion turned into firm moist lumps. Total time for evaporation was approximately one hour. In a second step, the lumps from step one were transferred to a grounded No. 14 ASTM (stainless steel) sieve of 8" diameter. The sieve was mounted above a sieve pan of the same diameter and the lumps pressed through the sieve openings with a rubber stopper. The particles that passed the screen openings collected in the sieve pan below. In a third step, the sieved product was spread in a flat plastic pan of 12" (width) by 24" (length) and dried in an oven for a minimum of 8 hours at 120° F. The free flowing granular product is identified as No. 8.

EXAMPLE 5

Preparation of Elvax® 150W-Coated Magnesium-Teflon® Granules

In this example, the moisture-resistant Magnesium-Teflon®-5% Elvax® 150W granular composition is prepared using essentially the same Process B method as described in Example 4, except that Elvax 150W-cyclohexane solution is used instead of Elvax 240W-cyclohexane solution. The products are identified as No. 9.

EXAMPLE 6

Preparation of Elvax® 240W-Coated Maenesium-Teflon® Particles

In this example, the moisture-resistant Magnesium-Teflon®-7.5% Elvax® 150W granular composition is prepared essentially the same Process B method as described in Example 4, except that the following formulation is used. The product is identified as No. 10.

200/325 atomized magnesium powders, 122 grams

Teflon® powder, 63 grams

Elvax® 240W-cyclohexane solution, 150 grams

EXAMPLE 7

Confirmation of Reduction in $H_2$ Out-Gassing for Magnesium Coated with 3 to 10% Elvax® 40W, 150W, and 240W The relative improvement in the moisture resistance of products prepared using varied Elvax® concentrations was confirmed by measuring hydrogen out-gassing from water challenged magnesium compositions. The testing was performed with a dual-chamber differential pressure system. Test samples ranging in weight from 200 to 300 mg were placed in a reaction chamber that was separated from a water reservoir (15 ml) by a valve. When the valve was opened and the water entered the test chamber, any rise in gas pressure due to generation of hydrogen gas was measured relative to the pressure of a control chamber (blank chamber) using a high accuracy differential transducer. The transducer signals were then amplified before being sent to an analog-digital converter and monitored by a PC workstation.

The dual chamber design enables the system to obtain hydrogen pressure readings in real-time, despite of the presence of water vapor. Out-gassing assessments were carried out in two phases. In the first phase, the powdered magnesium samples coated with 3 to 10% of Elvax® (40W, 150W, and 240W, respectively) were tested with distilled water in the dual chamber system for four hours. Table 3, below, summarizes the hourly hydrogen pressure readings, and the calculated percent-reduction in out-gassing relative to controls, which consists of uncoated magnesium in this set of tests.

TABLE 3

Hydrogen Pressure (hourly) at Amb. Temp. and % Reduction in Out-gassing for Powdered Magnesium with 3 to 10% Elvax ® *

| COATANT | PRODUCT ID** | GENERATED HYDROGEN PRESSURE 1 Hour (PSI) | 2 hours (PSI) | 3 hours (PSI) | 4 hours (PSI) |
|---|---|---|---|---|---|
| Uncoated Mg | (control) | 0.374 | 0.490 | 0.581 | 0.660 |
| 7% 240W Elvax ® | 1a, 1b, 1c | 0.049 | 0.070 | 0.095 | 0.115 |
| 3% 150W Elvax ® | 2a, 2b, 2c | 0.125 | 0.250 | 0.339 | 0.410 |
| 7% 150W Elvax ® | 3a, 3b, 3c | 0.075 | 0.120 | 0.145 | 0.180 |
| 10% 150W Elvax ® | 4a, 4b, 4c | 0.054 | 0.075 | 0.1 | 0.120 |
| 3% 40W Elvax ® | 5a, 5b, 5c | 0.148 | 0.270 | 0.35 | 0.420 |
| 7% 40W Elvax ® | 6a, 6b, 6c | 0.096 | 0.180 | 0.252 | 0.300 |
| 10% 40W Elvax ® | 7a, 7b, 7c | 0.068 | 0.130 | 0.194 | 0.250 |

TABLE 3-continued

Hydrogen Pressure (hourly) at Amb. Temp. and % Reduction in Out-gassing for Powdered Magnesium with 3 to 10% Elvax ® *

| | PERCENT REDUCTION IN OUT-GASSING$ 1 Hour (%) | 2 hours (%) | 3 hours (%) | 4 hours (%) |
|---|---|---|---|---|
| UNCOATED MAGNESIUM | ←----- (REFERENCE) -----→ | | | |
| | $(% Reduction relative to untreated Mg Particles) | | | |
| 7% 240W Elvax ® | 87 | 85 | 84 | 82 |
| 3% 150W Elvax ® | 67 | 50 | 42 | 38 |
| 7% 150W Elvax ® | 80 | 77 | 75 | 74 |
| 10% 150W Elvax ® | 86 | 84 | 83 | 82 |
| 3% 40W Elvax ® | 60 | 46 | 40 | 37 |
| 7% 40W Elvax ® | 74 | 63 | 57 | 54 |
| 10% 40W Elvax ® | 82 | 73 | 67 | 63 |

*BASIS: 200 Mg Magnesium, 200/325 Mesh, ambient

**Granulations for +200, −200/+325, and −325 meshes-designated as a, b, c, respectively.

Figure 1:
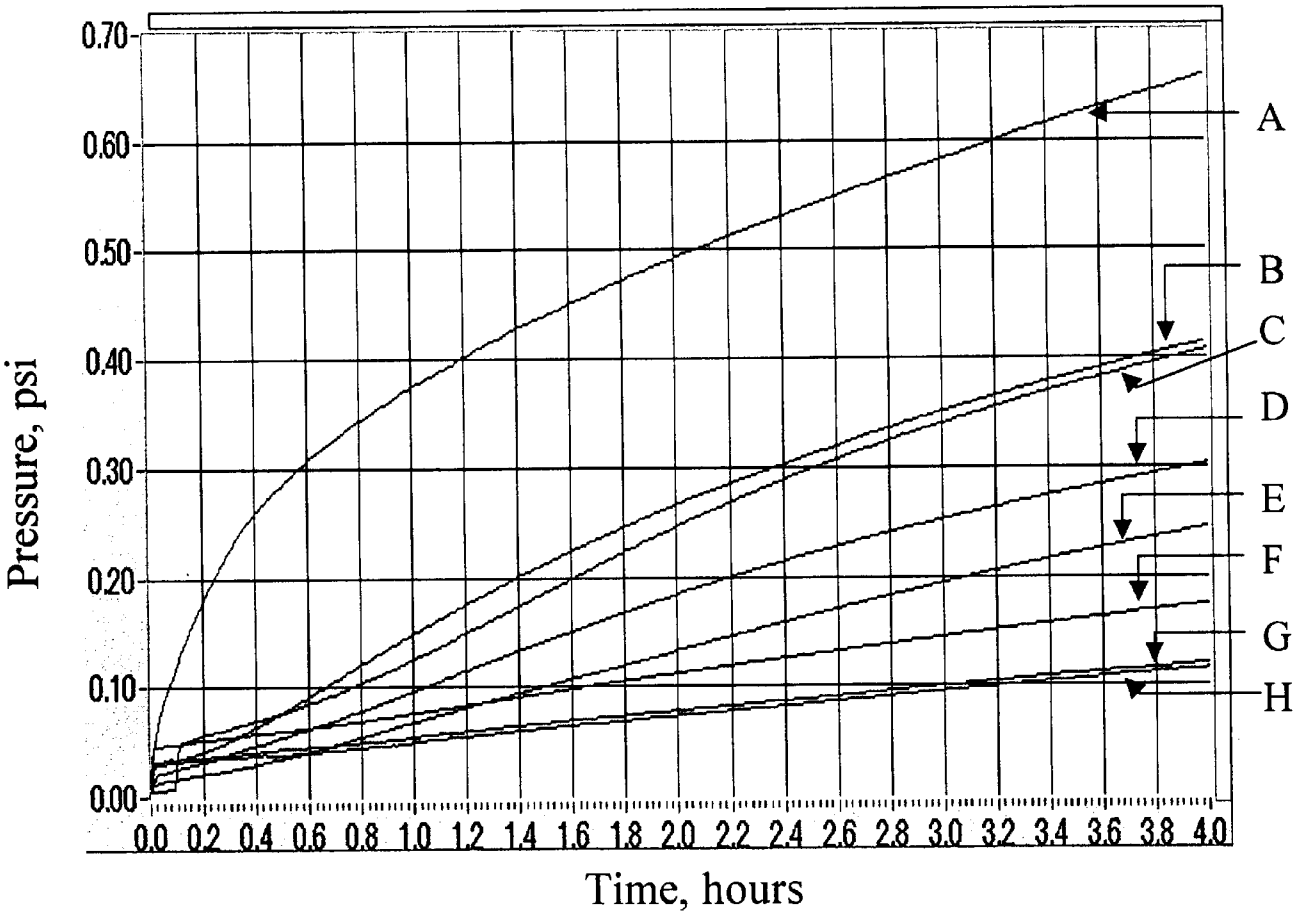
FIG. 1 graphically illustrates the hydrogen pressure generated in a fixed volume chamber, versus time, for wetted Elvax®—coated magnesium powder, and uncoated control, at ambient temperature. The pressure-time curves are alphabetically labeled as follows.

The hydrogen pressure verses time data for wetted magnesium, with and without Elvax® coatings, were plotted in FIG. 1, and the data is summarized by Table 4, below). The data were derived by measuring generated hydrogen pressure in a fixed volume test chamber, containing 200 mg of powdered sample (200/325 mesh) in contact with water at ambient temperature, versus time. The tested samples were powdered magnesium coated with 3 to 10% Elvax® using grades 40W, 150W, and 240W, respectively. The hydrogen pressure results for wetted magnesium coated with 40W Elvax® are shown in FIG. 1 by curves B (3%), D (7%) and E (10%); for wetted magnesium coated with 150W Elvax® the hydrogen pressure curves are shown in FIG. 1 by curves C (3%), F (7%) and G (10%), and for wetted magnesium coated with 240W Elvax®, the hydrogen pressure curve is shown by curve H (7%). Uncoated wetted magnesium pressure (control or reference) is shown by curve A.

The data, as illustrated by FIG. 1 and as summarized by Table 4, below, confirmed that uncoated, wetted, Mg particles generated the sharpest early rise in pressure, ranging from about 0.250 psi at about 0.4 hours, up to 0.650 psi at about 4 hours.

TABLE 4

Hydrogen Pressure Readings (PSI) verses Time (Hours) After Wetting of Elvax ® -Coated Mg Powder

| Time (hrs) | ←----- Hydrogen Pressure in PSI -----→ ←----- Elvax ® (Percent/Grade) -----→ 3%/ 40W | 3%/ 150W | 7%/ 40W | 10%/ 40W | 7%/ 150W | 10%/ 150W | 7%/ 240W | Mg/ Control |
|---|---|---|---|---|---|---|---|---|
| 0.0 | 0 | 0 | 0 | 0 | 0 | 0 | 0 | 0 |
| 0.4 | 0.060 | 0.070 | 0.050 | 0.030 | 0.060 | 0.040 | 0.040 | 0.252 |
| 0.8 | 0.120 | 0.100 | 0.090 | 0.060 | 0.070 | 0.050 | 0.045 | 0.350 |
| 1.2 | 0.180 | 0.150 | 0.120 | 0.080 | 0.080 | 0.060 | 0.055 | 0.400 |

TABLE 4-continued

Hydrogen Pressure Readings (PSI) verses Time (Hours) After Wetting of Elvax ® -Coated Mg Powder

| | ←----- Hydrogen Pressure in PSI -----→ | | | | | | | |
|---|---|---|---|---|---|---|---|---|
| | ←----- Elvax ® (Percent/Grade) -----→ | | | | | | | |
| Time (hrs) | 3%/ 40W | 3%/ 150W | 7%/ 40W | 10%/ 40W | 7%/ 150W | 10%/ 150W | 7%/ 240W | Mg/ Control |
| 1.6 | 0.230 | 0.200 | 0.150 | 0.110 | 0.100 | 0.070 | 0.065 | 0.450 |
| 2.0 | 0.270 | 0.250 | 0.180 | 0.130 | 0.120 | 0.075 | 0.070 | 0.490 |
| 2.4 | 0.300 | 0.290 | 0.230 | 0.160 | 0.130 | 0.080 | 0.075 | 0.530 |
| 2.8 | 0.340 | 0.330 | 0.240 | 0.180 | 0.140 | 0.095 | 0.090 | 0.570 |
| 3.2 | 0.360 | 0.350 | 0.260 | 0.210 | 0.150 | 0.100 | 0.100 | 0.600 |
| 3.6 | 0.390 | 0.380 | 0.290 | 0.230 | 0.160 | 0.110 | 0.105 | 0.630 |
| 4.0 | 0.420 | 0.410 | 0.300 | 0.250 | 0.180 | 0.120 | 0.115 | 0.660 |

It is notable that the early pressure rise (0 to about 1.4 hours) for the wetted uncoated Mg was nearly exponential. In contrast, the wetted Elvax®—coated Mg compositions produced much more gradual, nearly linear rises in hydrogen pressure with time, in which the rate of pressure rise decreased with time.

In particular, as summarized by Table 4, above, the hydrogen pressure of wetted Mg coated with Elvax® 40W and 150W (3% coatant) rose in nearly parallel curves from about 0.050 psi at 0.4 hours to about 0.400 psi at 4 hours. The best results of this test were provided by wetted Mg coated with Elvax® 240W, where the hydrogen pressure rose from about 0.030 psi at 0.4 hours to only about 0.120 psi at 4 hours.

EXAMPLE 8

Confirmation of Reduction in $H_2$ Out-Gassing for Mg—Teflon® Elvax® verses Mg—Teflon®—Hytemp®

In the second phase of testing, the methods and compositions of the invention were applied to a magnesium-Teflon® pyrotechnic composition well known in the art to demonstrate a high degree of undesirable moisture sensitivity, resulting in hazardous out-gassing of hydrogen. A series of moisture-resistant compositions were prepared employing the methods and coatings described above by Examples 4–6. The pressure testing was conducted as described for Example 7, above, and employed stock solutions of Elvax® ranging in concentration from 5 to 10%, for Elvax® 40W and 150W, but only used a 5% solution for application of Elvax® 240W. Each sample was tested with the same configuration as the powdered magnesium, for 60 to 75 hours at ambient temperature.

Table 5, below, summarizes the hydrogen pressure readings obtained after 30, 60, and 75 hours, respectively, and the obtained percent reduction in out-gassing in relative to a Magnesium-Teflon®—Hytemp® pyrotechnic composition system at ambient temperature.

TABLE 5

Generated Hydrogen Pressure (after 30, 60, and 75 hours) at Amb. Temperature and Percent Reduction in Out-gassing for Magnesium-TEFLON ® Compositions Containing 5 to 10% Elvax ®*

| | | GENERATED HYDROGEN PRESSURE | | |
|---|---|---|---|---|
| COATANT | PRODUCT ID | 30 Hours (PSI) | 60 Hours (PSI) | 75 Hours (PSI) |
| HYTEMP (HYCAR ® ) | | 0.4 | 0.490 | 0.525 |
| 5% 240W Elvax ® | 8 | 0.090 | 0.120 | 0.140 |
| 5% 150W Elvax ® | 9 | 0.140 | 0.155 | 0.155 |
| 7.5% 150W Elvax ® | 10 | 0.071 | 0.057 | 0.069 |
| 10% 150W Elvax ® | 11 | 0.121 | 0.141 | 0.148 |
| 5% 40W Elvax ® | 12 | 0.220 | 0.280 | N/A |
| 7.5% 40W Elvax ® | 13 | 0.117 | 0.148 | 0.166 |
| 10% 40W Elvax ® | 14 | 0.111 | 0.141 | 0.166 |

| | PERCENT REDUCTION IN OUT-GASSING | | |
|---|---|---|---|
| | (%) | 30 HR (%) | 60 HR 75 HR (%) |
| HYTEMP (HYCAR ® ) | ←----- (REFERENCE) -----→ | | |
| 5% 240W Elvax ® | 78 | 76 | 74 |
| 5% 150W Elvax ® | 64 | 69 | 69 |
| 7.5% 150W Elvax ® | 82 | 88 | 87 |
| 10% 150W Elvax ® | 70 | 71 | 71 |
| 5% 40W Elvax ® | 45 | 43 | N/A |
| 7.5% 40W Elvax ® | 71 | 70 | 68 |
| 10% 40W Elvax ® | 72 | 71 | 68 |

*BASIS: 200 mg Mg (200/325 Mesh) in composition, ambient temp.

The continuous pressure-time data were plotted (plot not shown, but data summarized by Table 6, below) for hydrogen pressure generated by 200 mg of powdered sample in contact with water at ambient temperature, versus time. The tested samples were powdered Mg coated with 5 to 10% Elvax® 40W and Teflon®. The wetted control composition formed only with a 5% Hycar® binder resulted in the highest generated hydrogen pressures, ranging from about 0.210 psi at 5 hours to about 0.500 psi at 65 hours (the pressure rise was exponential up to about 5 hours).

In contrast, the wetted Mg—Teflon®—Elvax® 40W compositions produced a nearly linear and significantly reduced hydrogen pressure rise.

TABLE 6

| Hydrogen Pressure Readings (PSI) verses Time (Hours) After Wetting of Elvax-Coated Mg Powder | | | | |
|---|---|---|---|---|
| | Hydrogen Pressure in PSI | | | |
| | Elvax ® (Percent/Grade) | | | |
| Time (hrs) | 5% Elvax ®/40 W | 7.5% Elvax ®/40 W | 10% Elvax ®/40 W | 5% Hycar Control |
| 0.0 | 0 | 0 | 0 | 0 |
| 5 | 0.120 | 0.050 | 0.050 | 0.210 |
| 10 | 0.150 | 0.075 | 070 | 0.270 |
| 15 | 0.170 | 0.090 | 0.080 | 0.310 |
| 20 | 0.190 | 0.100 | 0.090 | 0.350 |
| 25 | 0.210 | 0.110 | 0.100 | 0.375 |
| 30 | 0.220 | 0.120 | 0.110 | 0.400 |
| 35 | 0.230 | 0.125 | 0.120 | 0.420 |
| 40 | 0.240 | 0.130 | 0.120 | 0.440 |
| 45 | 0.250 | 0.135 | 0.125 | 0.450 |
| 50 | 0.270 | 0.140 | 0.135 | 0.470 |
| 55 | 0.275 | 0.145 | 0.145 | 0.480 |
| 60 | 0.280 | 0.150 | 0.145 | 0.490 |
| 65 | 0.290 | 0.150 | 0.145 | 0.500 |
| 70 | NA | 0.160 | 0.150 | 0.520 |
| 75 | NA | 0.160 | 0.160 | 0.525 |

As can be appreciated from Table 6, above, the Mg—Teflon® composition prepared using Elvax® 40W at 5% resulted in hydrogen pressure of about 0.130 at 5 hours, to about 0.290 psi at 65 hours. The Mg—Teflon composition prepared using Elvax® 40W at 7.5% resulted in hydrogen pressure of about 0.050 psi at 5 hours, to about 0.150 psi at 65 hours. Elvax® 150W 10% produced virtually analogous results with hydrogen pressure of about 0.050 psi at 5 hours, ranging to about 0.145 psi at 65 hours. This later measurement is more than 3-fold reduced relative to the hydrogen pressure rise exhibited by wetted magnesium formulated only with a Hycar® binder.

Hydrogen pressure generated by 200 mg of powdered sample (200/325 mesh) in contact with water at ambient temperature, was measured versus time. The tested samples were powdered Mg—Teflon® compositions coated with 5 to 10% Elvax® 150W. The control was Mg—Teflon® with 5% Hycare® binder. The continuous pressure-time data were plotted (plot not shown, but data is summarized by Table 7, below) for the generated hydrogen pressure versus time at ambient temperature.

TABLE 7

| Hydrogen Pressure Readings (PSI) verses Time (Hours) After Wetting of Elvax-Coated Mg - Teflon ® Powder | | | | |
|---|---|---|---|---|
| | Hydrogen Pressure in PSI | | | |
| | Elvax ® (Percent/Grade) | | | |
| Time (hrs) | 5% Elvax ®/150 W | 7.5% Elvax ®/150 W | 10% Elvax ®/150 W | 5% Hycar Control |
| 0.0 | 0 | 0 | 0 | 0 |
| 5 | 0.090 | 0.060 | 0.075 | 0.210 |
| 10 | 0.105 | 0.075 | 0.090 | 0.270 |
| 15 | 0.120 | 0.075 | 0.100 | 0.310 |
| 20 | 0.130 | 0.075 | 0.100 | 0.350 |
| 25 | 0.140 | 0.075 | 0.110 | 0.375 |
| 30 | 0.140 | 0.070 | 0.125 | 0.400 |
| 35 | 0.140 | 0.070 | 0.130 | 0.420 |
| 40 | 0.140 | 0.065 | 0.130 | 0.440 |
| 45 | 0.145 | 0.065 | 0.130 | 0.450 |
| 50 | 0.155 | 0.060 | 0.135 | 0.470 |

TABLE 7-continued

| Hydrogen Pressure Readings (PSI) verses Time (Hours) After Wetting of Elvax-Coated Mg - Teflon ® Powder | | | | |
|---|---|---|---|---|
| | Hydrogen Pressure in PSI | | | |
| | Elvax ® (Percent/Grade) | | | |
| Time (hrs) | 5% Elvax ®/150 W | 7.5% Elvax ®/150 W | 10% Elvax ®/150 W | 5% Hycar Control |
| 55 | 0.155 | 0.055 | 0.140 | 0.480 |
| 60 | 0.155 | 0.055 | 0.140 | 0.490 |
| 65 | 0.155 | 0.060 | 0.140 | 0.500 |
| 70 | 0.155 | 0.070 | 0.140 | 0.520 |
| 75 | 0.155 | 0.070 | 0.150 | 0.525 |

Thus, can be appreciated from Table 7, above, the wetted Mg—Teflon® composition formed solely with a 5% Hycar® binder resulted in the highest generated hydrogen pressures, ranging from about 0.210 psi at 5 hours to about 0.500 psi at 65 hours (as for the Hycar® control curve used with the 40W tests, the Mg—Teflon®—Hycar® pressure rise was exponential during the time period up to about 5 hours).

In contrast, the wetted Mg—Teflon® Elvax® 150W treated compositions produced a nearly linear and significantly reduced hydrogen pressure rise, that virtually stopped rising between 25–30 hours.

The wetted Mg—Teflon® Elvax® 150W at 5% resulted in hydrogen pressure of about 0.090 at 5 hours, which reached a plateau of about 0.150 psi at 25 hours. These were the best results for the Mg—Teflon® Elvax® 150W formulations.

The wetted Mg—Teflon® Elvax® 150W at 7.5% resulted in hydrogen pressure of about 0.060 psi at 5 hours, which then reached a plateau of about 0.06–0.07 psi between 10 to 75 hours.

Mg—Teflon®—Elvax® 150W 10% produced results intermediate between the 5% and 7.5% Elvax® 150W treated magnesium. The wetted Mg—Teflon® coated with 10% Elvax® 150W produced a hydrogen pressure of about 0.075 psi at 5 hours, ranging in a gradual linear increase to about 0.150 psi at 75 hours.

Hydrogen pressure generated by 200 mg of powdered sample in contact with water at ambient temperature, was measured versus time. The tested samples were powdered Mg—Teflon® compositions coated with 5% Elvax® 240W. The control was Mg—Teflon® with 5% Hycar® binder. Data from 5% Elvax® 240W were compared with those from 5% Elvax® 40W and 5% Elvax® 150W in Table 8, below. The continuous-pressure-time data were plotted and are illustrated by curves I, J, K and L of FIG. 2.

TABLE 8

| Hydrogen Pressure Readings (PSI) verses Time (Hours) After Wetting of Elvax-Coated Mg - Teflon ® Powder | | | | |
|---|---|---|---|---|
| | Hydrogen Pressure in PSI | | | |
| | Elvax ® (Percent/Grade) | | | |
| Time (hrs) | 5% Elvax ®/40 W | 5% Elvax ®/150 W | 5% Elvax ®/240 W | 5% Hycar Control |
| 0.0 | 0 | 0 | 0 | 0 |
| 5 | 0.120 | 0.090 | 0.040 | 0.210 |

TABLE 8-continued

Hydrogen Pressure Readings (PSI) verses Time (Hours) After Wetting of Elvax-Coated Mg - Teflon ® Powder

| | Hydrogen Pressure in PSI | | | |
|---|---|---|---|---|
| | Elvax ® (Percent/Grade) | | | |
| Time (hrs) | 5% Elvax ®/40 W | 5% Elvax ®/150 W | 5% Elvax ®/240 W | 5% Hycar Control |
| 10 | 0.150 | 0.105 | 0.060 | 0.270 |
| 15 | 0.170 | 0.120 | 0.070 | 0.310 |
| 20 | 0.190 | 0.130 | 0.075 | 0.350 |
| 25 | 0.210 | 0.140 | 0.080 | 0.375 |
| 30 | 0.220 | 0.140 | 0.090 | 0.400 |
| 35 | 0.230 | 0.140 | 0.095 | 0.420 |
| 40 | 0.240 | 0.140 | 0.100 | 0.440 |
| 45 | 0.250 | 0.145 | 0.105 | 0.450 |
| 50 | 0.270 | 0.155 | 0.110 | 0.470 |
| 55 | 0.275 | 0.155 | 0.115 | 0.480 |
| 60 | 0.280 | 0.155 | 0.120 | 0.490 |
| 65 | 0.290 | 0.155 | 0.125 | 0.500 |
| 70 | N/A | 0.155 | 0.130 | 0.520 |
| 75 | N/A | 0.155 | 0.140 | 0.525 |

As can be appreciated from Table 8, all grades of magnesium-Teflon® compositions coated with 5% Elvax® were substantially improved over the pressure produced by outgassing hydrogen by the conventional Hycar formulation. The lowest hydrogen pressure was produced by the Mg—Teflon® composition treated with 5% 240W Elvax®, for which the hydrogen pressure never exceeded 0.140 psi.

EXAMPLE 9

Reduction in $H_2$ Outgassing During Thermal Testing of Mg—Teflon®—Elvax® le;.5qThe 200 mg samples of the composition prepared with 5% Elvax® 240W, a preferred mode of the invention, was further tested at 140° F. for 60 hours with a single chamber absolute pressure system to evaluate the thermal impact on out-gassing characteristics. Results for 140° F. runs were plotted (plot not show, but data summarized by Table 9, below). The reference or control composition is the currently available Mg—Teflon®—Hytemp® flare system.

TABLE 9

Hydrogen Pressure Readings (PSI) verses Time (Hours) After Wetting of Elvax ®-Coated Mg - Teflon ® Powder

| | Hydrogen Pressure in PSI - Measured Together with Water Vapor Pressure Elvax ® (Percent/Grade) | | |
|---|---|---|---|
| Time (hrs) | Water vapor | 5%Elvax ®/240 W | 5% Hycar Control |
| 0.0 | 3.500 | 1.500 | 4.520 |
| 5 | 5.100 | 4.200 | 6.300 |
| 10 | 5.184 | 4.600 | 6.575 |
| 15 | 5.184 | 4.800 | 7.000 |
| 20 | 5.184 | 4.900 | 7.200 |
| 25 | 5.184 | 5.000 | 7.400 |
| 30 | 5.184 | 5.160 | 7.600 |
| 35 | 5.184 | 5.180 | 7.800 |
| 40 | 5.184 | 5.200 | 7.900 |
| 45 | 5.184 | 5.300 | 8.100 |
| 50 | 5.184 | 5.400 | 8.300 |
| 55 | 5.184 | N/A | 8.400 |

TABLE 9-continued

Hydrogen Pressure Readings (PSI) verses Time (Hours) After Wetting of Elvax ®-Coated Mg - Teflon ® Powder

| | Hydrogen Pressure in PSI - Measured Together with Water Vapor Pressure Elvax ® (Percent/Grade) | | |
|---|---|---|---|
| Time (hrs) | Water vapor | 5%Elvax ®/240 W | 5% Hycar Control |
| 60 | 5.184 | N/A | 8.510 |
| 65 | 5.184 | N/A | 8.700 |
| Water vapor pressure was 5.184 psi, constant after 10 hours | | | |

When the water vapor pressure of 5.184 psi is subtracted from the gross pressure, the net hydrogen pressure for the Hytemp (Hycar) formulation, after 50 hours, is (8.300–5.184) 3.116 psi. Similarly, for the composition prepared from Mg—Teflon®—Hytemp® 240, the net hydrogen pressure after 50 hours is (5.400–5.184) 0.210 psi.

EXAMPLE 10

Confirmation of Static Functioning Performance

A. Radiometric Performance Test:

Elvax®—coated Magnesium-Teflon® granules were consolidated with one increment at 11,000 psi into 0.75" by 2" semi-production scale pellets. Intermediate charge and first-fire compositions of the current Hytemp® system were applied to the pellets. The IR (infrared) output was measured with a radiometer at ambient temperature. Results are summarized in Table 10 which include burn time, rise time, peak intensity, and IR output expressed as percent of the current Hytemp® system.

As can be appreciated from Table 10, below, the Mg—Teflon®—Elvax® compositions perform as well, or better, than the current Hytemp® formulations in thermal performance tests.

B. Mechanical Compression Test:

Elvax®—coated Magnesium-Teflon® granules were consolidated at 11,000 psi into ⅜" by ⅜" pellets for testing in an Instron (Instron Corp., Canton, Mass.) mechanical property system. The pellets were placed on a platform and compressed by the load cell slowly released from the top until it was deformed or crushed. The load at this point was recorded as the crush strength (compression strength) of the pellet. At least five pellets for each formulation were tested to get an average. Table 10 contains the summarized results and the relative strengths compared to the current Hytemp® system.

TABLE 10

Relative Burn and Rise Time, Peak Intensity, and Radiometric Output for Mg-TEFLON ® Compositions Containing 5 to 10% Elvax ® *

| COATANT | Prod. ID | Burn time (sec) | Rise time (sec) | Peak Intensity (WATTS/STER) | Radiometric Output (WATTS SEC/STER) |
|---|---|---|---|---|---|
| Hytemp ® (Hycar) | | ←----- REFERENCE -----→ | | | |
| 5% 240W Elvax ® | 8 | N/A | N/A | N/A | N/A |
| 5% 150W Elvax ® | 9 | 99% | 90% | 97% | 102% |
| 7.5% 150W Elvax ® | 10 | 112% | 112% | 91% | 107% |
| 10% 150W Elvax ® | 11 | 132% | 130% | 75% | 106% |
| 5% 40W Elvax ® | 12 | 103% | 112% | 100% | 102% |

TABLE 10-continued

Relative Burn and Rise Time, Peak Intensity, and Radiometric Output for Mg-TEFLON ® Compositions Containing 5 to 10% Elvax ® *

| COATANT | Prod. ID | Burn time (sec) | Rise time (sec) | Peak Intensity (WATTS/STER) | Radiometric Output (WATTS SEC/STER) |
|---|---|---|---|---|---|
| 7.5% 40W Elvax ® | 13 | 125% | 104% | 79% | 108% |
| 10% 40W Elvax ® | 14 | 108% | 126% | 97% | 107% |

*BASIS: ¾" ID by 2" L pellet, 11,500 PSI loading pressure, coated with intermediate charge, and one groove first fire.

As can be appreciated from Table 10, the Mg—Teflon®—Elvax® compositions perform as well, or better, than the current Hytemp® formulations in the mechanical strength tests.

What is claimed is:

1. A process for the preparation of a storage-stable metal pyrotechnic fuel, which process comprises the steps of:

a. preparing a solution of at least one ethylene-vinyl acetate copolymer in cyclohexane;

b. adding to the solution of step (a) a powdered metal selected from the group consisting of powdered magnesium, powdered aluminum and combinations thereof to form a mixture;

c. mixing the combination of step (b) until a smooth mixture is formed;

d. mulling the smooth mixture of step (c) while allowing a portion of said cyclohexane to evaporate, until lumps of a cyclohexane-moist granular material are formed; and, e. allowing the moist granular material to dry.

2. The process of claim 1 wherein the solution of step (a) contains ethylene-vinyl acetate copolymer in a concentration of about three percent (3%) to about ten percent (10%) by weight.

3. The process of claim 1 further comprising the step of sieving the lumps of moist granular material of step (d) to a desired particle size before drying.

4. The process of claim 1 wherein step (b) further comprises the addition of a quantity of powdered tetrafluoroethylene mixed with the powdered metal.

5. A storage-stable powdered metal pyrotechnic fuel prepared by the process of:

a. preparing a solution of at least one ethylene-vinyl acetate copolymer in cyclohexane;

b. adding to the solution of step (a) a powdered metal selected from the group consisting of powdered magnesium, powdered aluminum and combinations thereof to form a mixture;

c. mixing the combination of step (b) until a smooth mixture is formed;

d. mulling the smooth mixture of step (c) while allowing a portion of said cyclohexane to evaporate, until lumps of a cyclohexane-moist granular material are formed; and, e. allowing the moist granular material to dry.

6. The storage-stable powdered metal pyrotechnic fuel of claim 5 wherein the powdered metal is magnesium powder having a particle size ranging from about 30 to about 325 mesh.

7. The storage-stable powdered metal pyrotechnic fuel of claim 5 wherein the powdered metal is atomized or ground magnesium powder.

8. The storage-stable powdered metal pyrotechnic fuel of claim 5 wherein a quantity of tetrafluoroethylene is mixed with the powdered metal of step (b).

9. The storage-stable powdered metal pyrotechnic fuel of claim 8 wherein the tetrafluoroethylene is present in an amount of from about fifteen percent (15%) to about twenty-five percent (25%) by weight of the final composition.

10. The storage-stable powdered metal pyrotechnic fuel of claim 5 wherein the at least one ethylene-vinyl acetate copolymer is characterized in that it has a melting point of 165° Fahrenheit, a vinyl acetate percentage of 28 percent, and a melt index of 43.

11. The storage-stable powdered metal pyrotechnic fuel of claim 5 wherein the at least one ethylene-vinyl acetate copolymer is characterized in that it has a melting point of 145° Fahrenheit, a vinyl acetate percentage of 32 percent, and a melt index of 43.

12. The storage-stable powdered metal pyrotechnic fuel of claim 5 wherein the at least one ethylene-vinyl acetate copolymer is characterized in that it has a melting point of 117° Fahrenheit, a vinyl acetate percentage of 40 percent, and a melt index of 52.

13. The storage-stable powdered metal pyrotechnic fuel of claim 5 wherein the at least one ethylene-vinyl acetate copolymer is present in an amount of from about three percent (3%) to about ten percent (10%) by weight of the final product.

14. The storage-stable powdered metal pyrotechnic fuel of claim 13 wherein the at least one ethylene-vinyl acetate copolymer is present in an amount of from about five percent (5%) to about ten percent (10%) by weight of the final product.

15. A storage-stable powdered metal pyrotechnic fuel prepared by the process of:

a. preparing a solution of at least one ethylene-vinyl acetate copolymer in cyclohexane;

b. adding to the solution of step (a) a powdered metal selected from the group consisting of powdered magnesium, powdered aluminum and combinations thereof to form a mixture;

c. mixing the combination of step (b) until a smooth mixture is formed;

d. mulling the smooth mixture of step (c) while allowing a portion of said cyclohexane to evaporate, until lumps of a cyclohexane-moist granular material are formed;

e. sieving the lumps of moist granular material of step (d) to a desired particle size; and, f. allowing the moist granular material to dry.

16. A pyrotechnic device comprising the storage-stable metal pyrotechnic fuel of claim 5.

17. A pyrotechnic device comprising the storage-stable metal pyrotechnic fuel of claim 8.

18. A pyrotechnic device comprising the storage-stable metal pyrotechnic fuel of claim 10.

19. A pyrotechnic device comprising the storage-stable metal pyrotechnic fuel of claim 11.

20. A pyrotechnic device comprising the storage-stable metal pyrotechnic fuel of claim 12.

21. A pyrotechnic device comprising the storage-stable metal pyrotechnic fuel of claim 15.

* * * * *